US007478761B2

(12) United States Patent
Karamanos et al.

(10) Patent No.: US 7,478,761 B2
(45) Date of Patent: Jan. 20, 2009

(54) SELF-CONTAINED VENTILATION FLOW CONTROL SYSTEM

(76) Inventors: John C. Karamanos, 1931 Patio Dr., San Jose, CA (US) 95125; Charles J. Viso, 507 Porter La., San Jose, CA (US) 95127-2510

( * ) Notice: Subject to any disclaimer, the term of this patent is extended or adjusted under 35 U.S.C. 154(b) by 252 days.

(21) Appl. No.: 10/092,933

(22) Filed: Mar. 6, 2002

(65) Prior Publication Data

US 2003/0171092 A1 Sep. 11, 2003

(51) Int. Cl.
*F24F 7/00* (2006.01)
*F24F 11/00* (2006.01)

(52) U.S. Cl. ..... 236/49.3; 454/239; 454/258; 165/217

(58) Field of Classification Search ..... 236/49.3, 236/49, 3; 454/238, 239, 255, 256, 258; 165/217
See application file for complete search history.

(56) References Cited

U.S. PATENT DOCUMENTS 3,653,590 A * 4/1972 Elsea ..... 236/49.3
4,459,819 A * 7/1984 Hargraves ..... 62/225
5,005,636 A * 4/1991 Haessig
5,168,894 A * 12/1992 Desmarais ..... 137/486
6,227,961 B1 * 5/2001 Moore et al. ..... 454/229
6,357,243 B1 * 3/2002 Efron et al. ..... 62/171

FOREIGN PATENT DOCUMENTS

JP 4-363695 * 12/1992 ..... 376/283

* cited by examiner

*Primary Examiner*—Marc E Norman
(74) *Attorney, Agent, or Firm*—Larry E. Henneman, Jr.; Henneman & Assoc., PLC

(57) ABSTRACT

A preassembled flow control unit includes a plenum, a flow controller mounted to the plenum, and a flow control sensor mounted to the plenum. An isolation valve selectively blocks the flow of air between the plenum and the flow controller. An optional thermal coil is also mounted to the plenum to control the temperature of air flowing therethrough. In a particular embodiment, the thermal coil is mounted to an open end of the plenum opposite the flow controller, and the fluid lines serving the thermal coil are also mounted to the plenum, with an automatic valve in at least one of the fluid lines. An optional protective bracket protects the automatic valve from incidental damage during transportation an installation of the flow control unit. An electrical disconnect and a power converter are also mounted on the plenum. The power converter receives electrical power from the disconnect, converts a first voltage from the disconnect to a second lower voltage, and provides the second voltage to the flow controller and/or the automatic valve. Preassembly of the flow control unit facilitates pretesting and/or precertification of the flow control unit, and provides for easier installation.

51 Claims, 4 Drawing Sheets

SELF-CONTAINED VENTILATION FLOW CONTROL SYSTEM

BACKGROUND OF THE INVENTION

1. Field of the Invention

This invention relates generally to ventilation systems and methods, and more particularly to self-contained heating, ventilation, and air conditioning (HVAC) control systems. Even more particularly, the invention relates to HVAC flow control systems which are suitable for prefabrication and installation as a unit.

2. Description of the Background Art

In many circumstances it is desirable to maintain a positive pressure in a room or work area, relative to adjoining rooms, hallways, etc. For example, a positive pressure inside a hospital operating room prevents airborne contaminants from entering the room when doors are opened. The positive pressure inside the room causes air to flow out of instead of in through open doors. Similarly, a positive pressure inside a room ensures that unwanted fumes flow efficiently out through exhaust vents (e.g., vent hoods, isolation cabinets, etc.), rather than backing up into the room.

Flow controllers are known that control the flow rate of air through a vent. Such flow controllers are typically installed as part of an HVAC system. Construction workers on site mount the controllers in air ducts of the HVAC system. The installation is labor intensive, and therefore very expensive.

In some circumstances, it is also desirable to be able to isolate a room or an area from the ventilation system of the rest of a structure. For example, isolation of a particular room can prevent a toxic release (e.g., a gas leak) from contaminating other areas. In the case of certain toxic gasses, effective isolation can mean the difference between life and death for workers in adjoining areas. As another example, isolation of a section of an HVAC system facilitates decontamination of the isolated section, without contaminating or shutting down the entire HVAC system. Known flow controllers are unsuitable for isolation applications, because their leakage ratings are typically greater than or equal to eight percent.

Further, in certain critical applications it is desirable to pretest and/or precertify components of a system prior to shipping and installation. Components of an HVAC system that are separately installed on site cannot be pretested and/or precertified as a unit. If the components do not meet predetermined criteria after installation, the components must be torn out and substitute components installed. Such rebuilds are also very labor intensive and expensive.

Another problem with precertifying components before they are installed is that the function of a component can depend on other components and installation specifics. For example, flow sensors can give different readings depending on the amount of turbulence in the flowing air. Thus, readings provided by sensors can depend on whether the sensor is disposed in a straight section of duct or adjacent to a bent section of duct. As another example, air flow rate through a flow controller can depend on other components (e.g., heating coils) in the path of the air flow.

What is needed, therefore, is a flow control system for controlling the flow of air into a confined space. What is also needed is a ventilation flow control system that can effectively isolate sections of an HVAC system. What is also needed is a flow control system that can be tested and/or certified prior to installation. What is also needed is a method of installing a flow control system that is less labor intensive than current methods, and lends itself to preinstallation testing and/or certification of the components.

SUMMARY

The present invention overcomes the problems associated with the prior art by providing a self-contained ventilation flow control unit. The invention facilitates pretesting and/or precertification of the flow control unit, and installation of the flow control unit as a single component.

The flow control unit includes a plenum, a flow controller mounted to the plenum, and a flow control sensor mounted to the plenum. In a particular embodiment, the sensor is mounted in a duct section between the plenum and the flow controller. An isolation valve selectively blocks the flow of air between the plenum and the flow controller. In a particular embodiment, the isolation valve is a fixed blade damper with less than one percent leakage.

A thermal coil is mounted to the plenum to control the temperature of air flowing therethrough. In a particular embodiment, the thermal coil is mounted to an open end of the plenum opposite the flow controller. The fluid lines serving the thermal coil are also mounted to the plenum, with an automatic valve in at least one of the fluid lines. An optional protective bracket protects the automatic valve from incidental damage during transportation and installation of the flow control unit. The bracket includes a base with an opening to facilitate the passage of a valve stem therethrough. A pair of risers extend upward from opposite edges of the base to protect the automatic valve positioned therebetween.

An electrical disconnect and a power converter are also mounted on the plenum. The power converter receives electrical power from the disconnect, converts a first voltage from the disconnect to a second lower voltage, and provides the second voltage to the flow controller and/or the automatic valve. In a particular embodiment, the converter is a transformer that converts 110 VAC to 24 VAC.

A ventilation flow control system includes a plurality of the flow control units and a master control unit. The flow control units each include a duct, a flow controller mounted to the duct, and a sensor mounted to the duct. A first one of the flow control units monitors and controls the flow of air into a room. A second one of the flow control units monitors and controls air flow out of the room. The master control unit coordinates and controls the individual flow control units. Optionally, the first flow control unit includes a thermal coil for heating and/or cooling the air flowing into the room.

A method of installing a ventilation flow control unit is also described. The method includes the steps of preassembling the flow control unit, and installing the flow control unit in a ventilation system. In a particular method, the step of preassembling the flow control unit includes mounting a flow controller to a duct and mounting a flow sensor to the duct. In a more particular method, the step of assembling the flow control unit includes mounting an isolation valve to said duct. In another more particular method, the step of assembling the flow control unit includes mounting a thermal coil to the duct. In yet a more particular method, the step of assembling the flow control unit includes mounting at least one of the fluid supply lines of the thermal coil to the duct. In another particular method, an automatic valve is provided in one of the fluid supply lines, and is protected by a bracket to prevent damage during transportation and installation. In another more particular method, the step of assembling the flow control unit includes mounting an electrical disconnect and/or a power converter to the duct.

Assembly of the flow control unit prior to installation facilitates pretesting and/or precertification of the unit as whole. Preassembly of the unit also provides a significant reduction in the amount of time and effort required to install the flow control unit. Also, preassembly facilitates discovery of defects in the unit as a whole prior to transportation and installation.

BRIEF DESCRIPTION OF THE DRAWINGS

The present invention is described with reference to the following drawings, wherein like reference numbers denote substantially similar elements.

DETAILED DESCRIPTION

The present invention overcomes the problems associated with the prior art, by providing a ventilation flow control system, that includes flow control units that can be tested and/or certified prior to installation, and can be efficiently installed as single units. In the following description, numerous specific details are set forth (e.g., particular sensor type, particular flow controller type, etc.) in order to provide a thorough understanding of the invention. Those skilled in the art will recognize, however, that the invention may be practiced apart from these specific details. In other instances, details of well known HVAC design and construction practices (e.g., installation, electronic control, etc.) and components have been omitted, so as not to unnecessarily obscure the present invention.

Figure 1:
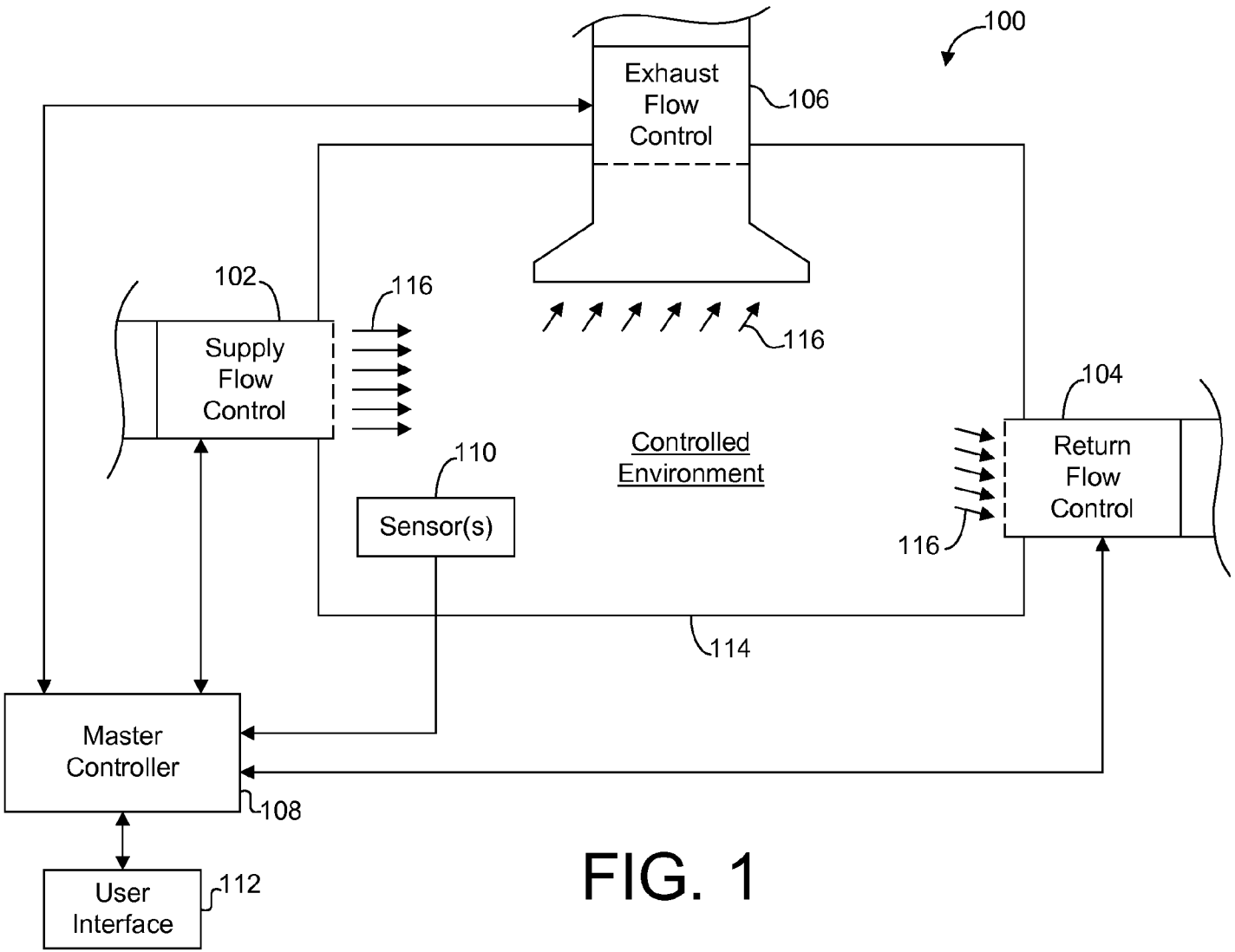
FIG. 1 is a block diagram of a ventilation flow control system including multiple flow control units according to one embodiment of the present invention.

FIG. 1 shows a ventilation flow control system 100 to include a supply flow control unit 102, a return flow control unit 104, an exhaust flow control unit 106, a master controller 108, one or more sensors 110, and a user interface 112. System 100 controls the flow of air into and out of a controlled environment 114 (e.g., a room, laboratory, work area, etc.). Arrows 116 illustrate air flow.

Supply flow control unit 102 is disposed in an air supply duct of the building's HVAC system (only ends of ducts shown), and controls the flow of fresh air into room 114. Similarly, return flow control unit 104 is disposed in a return duct, and controls the flow of air out of room 114 back to the HVAC system. Exhaust flow control unit 106 is disposed in an exhaust system (e.g., a fume hood), and controls the flow of air out of room 114 through the exhaust system.

Master controller 108 receives signals from each of flow control units 102, 104, and 106 indicating the actual amount of air flowing through the respective control units. Master controller 108 also receives signals from sensor(s) 110 (e.g., temperature sensor, pressure sensor, etc.). Master controller 108 then uses the signals received from control units 102, 104, and 106, and/or the signals received from sensors 110 to generate control signals for control units 102, 104, and 106.

A positive pressure is maintained by allowing more air to flow into room 114 than is flowing out. As long as the amount of air flowing in through supply flow control unit 102 is greater than the sum of the air flowing out through return flow control unit 104, out through exhaust flow control unit 106, and out through leakage (e.g., under doors, through cracks, etc.), a positive pressure will be maintained in room 114. It is important to note that flow control units 102, 104, and 106 actually measure the flow of air, and do not merely rely on the position of dampers or the like.

Ventilation flow control system can also detect and accommodate changes in the status of room 114. For example, the brief opening of a door (not shown) would allow air to escape from room 114 in excess of the normal leakage amount. This change can be detected by sensor(s) 110 indicating a decrease in pressure. Alternatively, the change can be detected by the decreased flow of air out through return system 104 and/or exhaust system 106. The change can be accommodated by master controller 108 sending control signals to supply unit 102 to increase the amount of air flowing into room 114, and/or sending control signals to return unit 104 to decrease the flow of air out of room 114. When master controller detects that room 114 has returned to its normal state (i.e., the door is shut), master controller sends control signals to return control units 102, 104, and 106 to their normal flow rates.

As another example, positive pressure can be maintained in room 114, even when the exhaust system is in operation. Master controller 108 causes supply unit 102 to increase the flow of air into room 114, and causes return unit 104 to greatly reduce the amount of air flowing out of room 114 through the return duct, thereby increasing the pressure in room 114. Master controller 108 then sets the rate of flow out through the exhaust unit 106 at a point slightly lower than the flow in through supply unit 102, to achieve effective exhaust while maintaining a positive pressure in room 114.

It is anticipated that master controller 108 will be embodied in a personal computer, and user interface 112 will include a display, keyboard, pointing device, etc. It is also anticipated that master controller 108 will control additional flow control units disposed in additional rooms. However, it should be understood that master controller 108, user interface 112, and sensor(s) 110 could be embodied in dedicated controller with a display and keypad, similar to a programmable thermostat.

Figure 2:
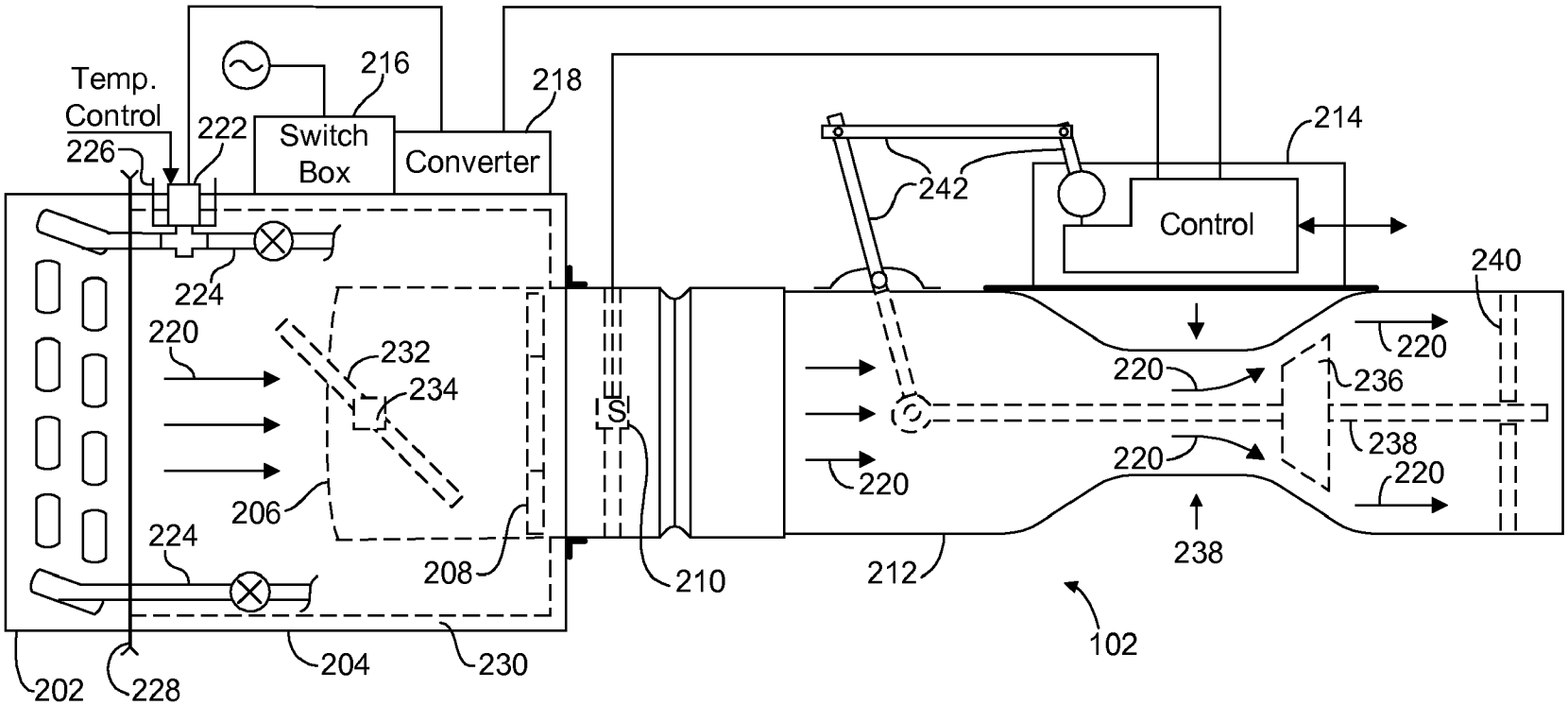
FIG. 2 is a diagrammatic representation of flow control unit of FIG. 1.

FIG. 2 is a diagrammatic representation showing supply flow control unit 102 in greater detail to include a thermal coil 202, a plenum 204, an isolation valve 206, a flow straightener 208, a flow sensor 210, a flow controller 212, an electromechanical controller 214, a switch box 216, and a power converter 218. Lines 220 illustrate the flow of air through supply flow control device 102. Return flow control device 104 (FIG. 1) and exhaust flow control device 106 (FIG. 1) are similar to supply flow control device 102, except that they do not include a thermal coil.

In this embodiment, thermal coil 202 is a radiator that transfers heat to/from air passing through flow control unit 102. Responsive to a temperature control signal (from master controller 108 or some other control device), an automatic valve 222 selectively allows a heating or cooling fluid to flow through thermal coil 202. Valve 222 is mounted in one of a pair of fluid lines 224 (one supply and one return) of thermal coil 202. Fluid lines 224 are mounted to plenum 204 by one or more brackets (not shown). A protective bracket 226 protects automatic valve 222 from damage during transportation and installation of control unit 102.

In this particular embodiment, plenum 204 is a terminal box (i.e., a box with one open side), and thermal coil 202 is fixed to the open end of plenum 204 by an edge flange 228. It should be understood, however, that the term "plenum", as used herein, shall be interpreted broadly to include any duct portion or the like capable of providing a means for mounting together the various components of flow control unit 102. The joint between thermal coil 202 and plenum 204 is sealed with sealing compound (e.g., silicone) to prevent air leakage. Plenum 204 also includes an insulation layer 230 to prevent thermal losses and reduce noise.

Isolation valve 206 is mounted in a hole cut into plenum 204 opposite thermal coil 202. Isolation valve 206 includes a blade 232 mounted to a shaft 234. An end of shaft 232 extends through a wall of plenum 204, and has a handle (not shown) mounted thereto to facilitate the manual opening and closing of isolation valve 206. Alternatively, an automatic actuator can be mounted to shaft 234 to facilitate automatic control of isolation valve 206.

It might at first appear redundant to provide isolation valve 206 in a unit with flow controller 212. However, isolation valve 206 has a leakage rating of between 0.1 percent to 4.0 percent (preferrably no more than one percent), whereas flow controllers such as flow controller 212 typically have a leakage rating of eight percent or greater. Thus, isolation valve 206 in combination with flow controller 212 provides far more effective isolation between portions of an HVAC system, than would flow controller 212 alone. Effective isolation provides an important advantage in containing accidental discharges and/or during decontamination procedures.

Flow straightener 208 and sensor 210 are mounted in a portion of the duct of isolation valve 206. Sensor 210 generates a signal indicative of the flow rate of air past sensor 210, and provides the signal to control unit 214. In this particular embodiment, sensor 210 is a FLOWSTAR® sensor by Enviro-Tec, Inc. of Largo, Fla. Flow straightener 208 reduces the amount of turbulence in the air flowing past sensor 210, resulting in a more accurate flow rate measurement. Turbulence is also reduced by the straight-through configuration of flow control device 102.

Flow controller 212 includes a plug 236 adapted to selectively occlude a narrowed section 238 of the duct of flow controller 212. Plug 236 is mounted on a shaft 238 that is held in a centered position by a bracket 240, while being allowed to move along an axis passing through narrowed portion 238. Responsive to the flow rate signal from sensor 210, and a predetermined set point (provided by master controller 108 or preset by a user), control unit 214, via linkage arms 242, moves plug 236 to increase or decrease the air flow through flow controller 212. In this particular embodiment, flow controller 212 is a TCX-865 controller available from Andover Controls of Andover, Mass.

Switch box 216 is mounted to plenum 204, and houses a convenient electrical disconnect for flow control unit 102. Providing a disconnect on each flow control unit allows a unit to be powered down for service, without interrupting power to other units. Further, the disconnects need only be rated for the amount of power required to drive a single flow control unit. In this embodiment, the disconnect is a simple single-pole-double-through switch.

Converter 218 is also mounted to plenum 204. Converter 218 receives a first voltage (e.g., 110 VAC) from switch box 216, and converts the voltage to a lower voltage (e.g., 24 VAC) suitable for use by electro-mechanical controller 214 and/or automatic valve 222. In this particular embodiment, converter 214 is a transformer with a 110V primary winding and a 24V secondary winding.

One of the principal advantages of flow control unit 102 is that it can be assembled as a unit prior to shipping and installation. Therefore, flow control unit 102 can be pretested and/or precertified prior to installation. Note that while individual components may have been pretested in the prior art, there has been no way to pretest or precertify how the assembly of components will function together. Certain parameters (e.g., turbulence, leakage, etc.) cannot be adequately tested until the unit is assembled. Further those parameters of the assembled unit may affect the calibration and/or operation of the entire system.

Figure 3:
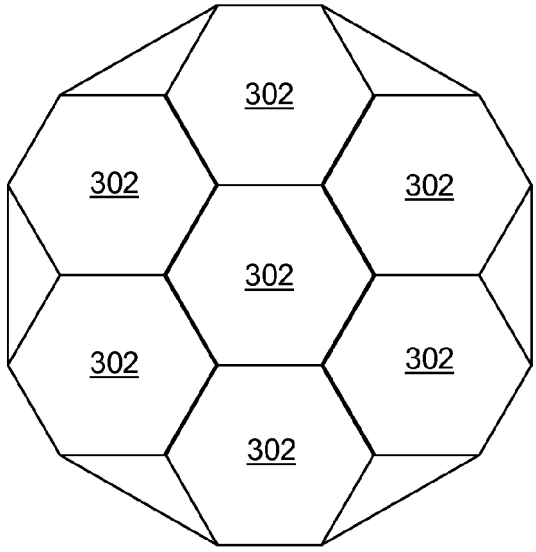
FIG. 3 is an in-line view of a flow straightener of the flow control unit of FIG. 2.

FIG. 3 is an in-line view of flow straightener 208. Flow straightener 208 includes a plurality of hexagonal passages 302. This honey-comb design of flow straightener 208 has proven effective in reducing turbulence at sensor 210.

Figure 4:
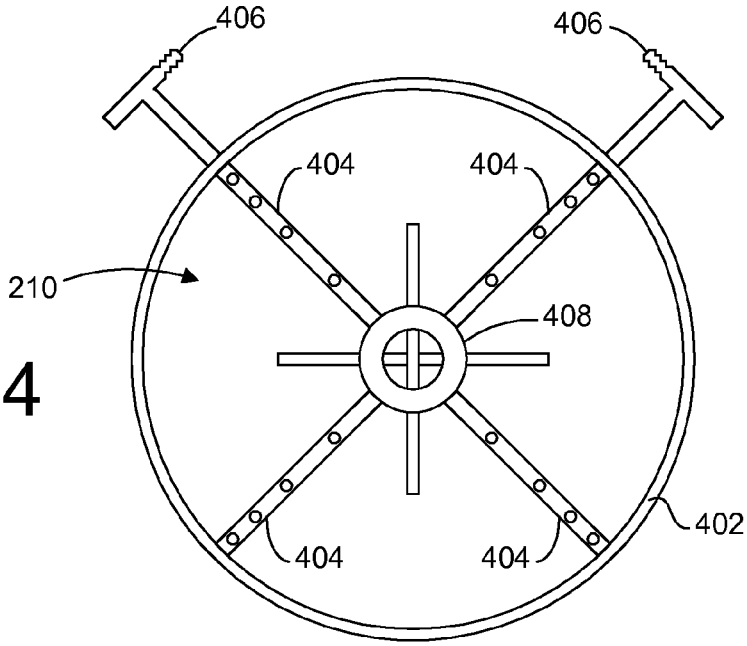
FIG. 4 is an in-line view of a flow sensor of the flow control unit of FIG. 2.

FIG. 4 is an in-line view of sensor 210. As shown in FIG. 4, sensor 210 is supported in the center of a portion of duct 402 by a plurality of sensing rods 404. Sensing rods 404 also include brass field pressure measuring taps 406 for providing a pressure signal indicative of the air flow rate through duct 402, and terminate at a center averaging chamber 408. The particular type of sensor, and the operation thereof is not considered germane to the present invention, and is not, therefore, described in detail herein.

Figure 5:
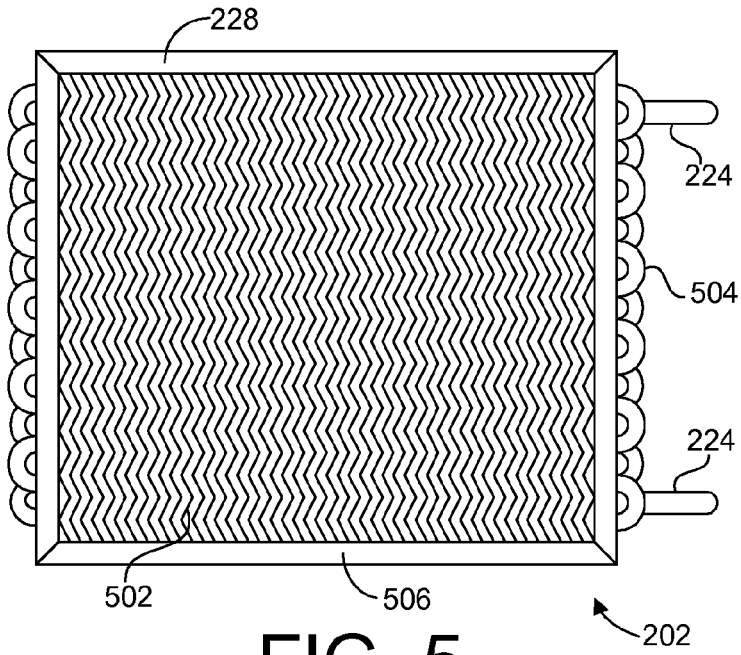
FIG. 5 is an in-line view of a thermal coil of the flow control unit of FIG. 2.

FIG. 5 is an in-line view of thermal coil 202. As shown in FIG. 5, thermal coil 202 includes a plurality of thermally conductive heat fins 502 in contact with fluid tube coils 504. Heat from a cooling fluid circulated through fluid tube coils 504 is transferred via fins 502 to air flowing through fins 502. Thermal coil 202 is partially encased in a housing 506, which forms attachment flanges 228 on both sides of thermal coil 202. Attachment flanges 228 provide a means for mounting thermal coil 202 to plenum 204 (FIG. 2) and the supply duct of an HVAC system (not shown).

It should be noted that thermal coil 202 can also be used to cool air passing therethrough, by circulating a coolant through tube coils 504. It should also be noted that thermal coil 202 can be an electrical coil instead of a fluid coil.

Figure 6:
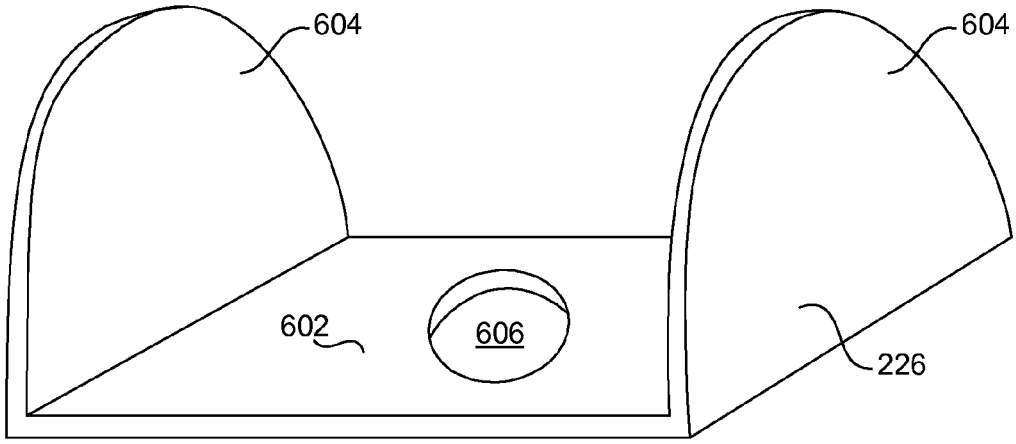
FIG. 6 is a perspective view of a protection bracket shown in FIG. 2.

FIG. 6 is a perspective view of protection bracket 226. As shown in FIG. 6, bracket 226 includes a base portion 602 and a pair of risers 604. Base portion 602 defines an aperture 606 to facilitate the passage of an automatic valve stem. Bracket 226 is easily manufactured from a single piece of material by forming two bends to define base 602 and risers 604, and punching aperture 606 in base 602.

Bracket 226 is installed on top of a valve, with the stem of the valve passing up through opening 606. Then, when the automatic valve controller is fixed to the stem, the valve controller is disposed between risers 604, which provide protection against accidental damage during transportation and installation.

In the prior art, it was not necessary to provide such protection because the automatic valves were not installed until the thermal coil was installed at the construction site. Thus, there was no risk of damage during transportation and installation of the thermal coil. Further, thermal coils are typically installed in overhead locations, where they are not particularly vulnerable to incidental damage. However, the inventors have found that when the automatic valves are mounted to the thermal coils prior to transportation and installation, the automatic valves are frequently damaged. Bracket 226 has proved an inexpensive and effective means for preventing such damage.

The description of particular embodiments of the present invention is now complete. Many of the described features may be substituted, altered or omitted without departing from the scope of the invention. For example, alternate flow controllers may be substituted for the particular model of flow controller 212 disclosed. Similarly, alternate flow sensors (e.g., differential pressure sensors) may be substituted for the particular sensor disclosed. As another example, the usefulness of the flow control units of the present invention is not limited to maintaining a desired pressure in a room. Rather, the flow control units can be used anywhere it is desirable to control flow rates (e.g., diverting heating/cooling from unoccupied areas). These and other deviations from the particular embodiments shown will be apparent to those skilled in the art, particularly in view of the foregoing disclosure. Indeed, unless explicitly stated, no single component is considered to be an essential element of the invention.

We claim:

1. A ventilation flow control unit comprising:

a plenum;

a flow controller mounted to said plenum;

an isolation valve fixed to said plenum to selectively block the flow of air between said plenum and said flow controller; and a flow sensor mounted to said plenum; and wherein said plenum, said flow controller, said isolation valve, and said flow sensor are preassembled to form said ventilation flow control unit, thereby enabling said ventilation flow control unit to be installed in an HVAC system as a single unit.

2. A ventilation flow control unit according to claim 1, wherein said sensor is mounted in a duct section fixed between said plenum and said flow controller.

3. A ventilation flow control unit according to claim 1, wherein the leakage of said isolation valve is no more than one percent.

4. A ventilation flow control unit according to claim 1, wherein said isolation valve comprises a damper.

5. A ventilation flow control unit according to claim 4, wherein said damper is a fixed blade damper.

6. A ventilation flow control unit according to claim 1, wherein said plenum, said flow controller, and said isolation valve are arranged in a straight-through configuration such that air can flow generally straight through said ventilation flow control unit.

7. A ventilation flow control unit according to claim 1, further comprising a flow straightener mounted to said plenum adjacent said flow sensor, said flow straightener reducing the turbulence of air flowing past said flow sensor.

8. A ventilation flow control unit comprising:

a plenum;

a flow controller mounted to said plenum;

a flow sensor mounted to said plenum;

a thermal coil fixed to said plenum, for affecting the temperature of air passing through said ventilation flow control unit; and an automatic valve connected with at least one fluid line of said thermal coil; and wherein said plenum, said flow controller, said flow sensor, said thermal coil, and said automatic valve are preassembled to form said ventilation flow control unit, thereby enabling said ventilation flow control unit to be installed in an HVAC system as a single unit.

9. A ventilation flow control unit according to claim 8, wherein said thermal coil is mounted to an open end of said plenum opposite said flow controller.

10. A ventilation flow control unit according to claim 8, wherein at least one fluid line of said thermal coil is mounted to said plenum.

11. A ventilation flow control unit according to claim 8, further comprising a protection bracket mounted to protect said automatic valve from damage during transportation and installation of said ventilation flow control unit.

12. A ventilation flow control unit according to claim 11, wherein said protection bracket includes:

a base defining an opening to facilitate the passage of a valve stem;

a first riser extending from a first edge of said base; and a second riser extending from a second edge of said base opposite said first edge.

13. A ventilation flow control unit according to claim 8, wherein said plenum is insulated.

14. A ventilation flow control unit according to claim 8, wherein said plenum, said flow controller, and said thermal coil are arranged in a straight-through configuration such that air can flow generally straight through said venilation flow control unit.

15. A venilation flow control unit according to claim 8, further comprising a flow straightener mounted to said plenum adjacent said flow sensor, said flow straightener reducing the turbulence of air flowing past said flow sensor.

16. A ventilation flow control unit comprising:

a plenum;

a flow controller mounted to said plenum;

a thermal coil with at least one automatic fluid valve;

a flow sensor mounted to said plenum;

an electrical disconnect; and a voltage converter electrically coupled to receive electrical power from said disconnect, for converting a first voltage received from said disconnect to a second lower voltage and providing said lower voltage to said automatic fluid valve; and wherein said plenum, said flow controller, said thermal coil, said flow sensor, said electrical disconnect, and said voltage controller are preassemble to form said ventilation flow control unit, thereby enabling said ventilation flow control unit to be installed in an HVAC system as a single unit.

17. A ventilation flow control unit according to claim 16, wherein said electrical disconnect is mounted on said plenum.

18. A ventilation flow control unit according to claim 16, wherein said converter provides low voltage to said flow controller.

19. A ventilation flow control unit according to claim 18, wherein said plenum, said flow controller, and said thermal coil are arranged in a straight-through configuration such that air can flow generally straight through said ventilation flow control unit.

20. A ventilation flow control unit according to claim 16, further comprising a flow straightener mounted to said plenum adjacent said flow sensor, said flow straightener reducing the turbulence of air flowing past said flow sensor.

21. A method of installing a ventilation flow control unit, comprising:

preassembling said flow control unit by mounting a flow controller to a duct, mounting a flow sensor to said duct, and mounting a thermal coil to said duct including securing at least one fluid line of said thermal coil to said duct and mounting an automatic valve in said fluid line; and installing said preassembled flow control unit in an HVAC system.

22. A method of installing a ventilation flow control unit according to claim 21, wherein said step of preassembling said flow control unit further includes mounting an isolation valve to said duct to selectively block the flow of air between said duct and said flow controller.

23. A method of installing a ventilation flow control unit according to claim 21, wherein said step of mounting an automatic valve in said fluid line includes mounting a protective bracket around said automatic valve.

24. A method of installing a ventilation flow control unit according to claim 21, wherein said step of preassembling said flow control unit further includes mounting a flow straigtener to duct adjacent flow sensor.

25. A method of installing a ventilation flow control unit, comprising:

preassembling said flow control unit by mounting a flow controller to a duct, mounting a flow sensor to said duct, mounting a flow straightener to said duct adjacent said flow sensor, and mounting an electrical disconnect to said duct; and installing said preassembled flow control unit in an HVAC system.

26. A method of installing a ventilation flow control unit according to claim 25, wherein said step of preassembling said flow control unit further includes mounting an electrical converter to said duct for converting a voltage from said electrical disconnect to a second lower voltage.

27. A method of installing a ventilation flow control unit comprising:

preassembling said flow control unit by mounting a flow controller to a duct, mounting a flow sensor to said duct, mounting a thermal coil to said duct, and mounting an isolation valve to said duct, said isolation valve selectively blocking the flow of air between said duct and said flow controller; and installing said preassembled flow control unit in an HVAC system.

28. A method of installing a ventilation flow control unit according to claim 27, wherein said step of preassembling said flow control unit includes mounting an electrical disconnect to said duct.

29. A method of installing a ventilation flow control unit according to claim 5, wherein said step of preassembling said flow control unit includes mounting an electrical converter to said duct.

30. A method of installing a ventilation flow control unit according to claim 29, wherein said step of preassembling said flow control unit includes electrically coupling said flow controller to said electrical converter.

31. A method of installing a ventilation flow control unit according to claim 29, wherein said step of preassembling said flow control unit includes:

mounting an automatic valve to a fluid line of said thermal coil to control the flow of fluid through said fluid coil; and electrically coupling said automatic valve to said electrical converter.

32. A method of installing a ventilation flow control unit according to claim 31, wherein said step of preassembling said flow control unit includes electrically coupling said flow controller to said electrical converter.

33. A method of installing a ventilation flow control unit according to claim 27, wherein said step of preassembling said flow control unit further includes mounting a flow straightener to said duct adjacent said flow sensor.

34. A ventilation flow control system comprising:

a first flow control unit for controlling the flow of air into a room, said first flow control unit including a duct, a flow controller mounted to said duct, and a sensor mounted to said duct;

a second flow control unit for controlling the flow of air out of said room, said second flow control unit including a duct, a flow controller mounted to said duct, and a sensor mounted to said duct; and a control unit for receiving feedback signals from said sensors and providing control signals to said flow controllers; and wherein at least one of said first and second flow control units includes an isolation valve.

35. A ventilation flow control system according to claim 34, wherein said first flow control unit further includes a thermal coil mounted to said duct of said first flow control unit.

36. A ventilation flow control system according to claim 34, wherein both of said first and second flow control units include an isolation valve.

37. A ventilation flow control system according to claim 34, wherein at least one of said first and second flow control units include an electrical disconnect.

38. A ventilation flow control system according to claim 37, wherein said at least one of said first and second flow control units further includes an electrical converter for converting a voltage from said electrical disconnect to a lower voltage.

39. A ventilation flow control system according to claim 34, further comprising a third flow control unit for controlling the flow of air out of said room, said third flow control unit including a duct, a flow controller mounted to said duct, and a sensor mounted to said duct.

40. A ventilation flow control system according to claim 39, wherein said control unit receives feedback signals from and provides control signals to said third flow control unit.

41. A ventilation flow control system according to claim 40, wherein:

said first flow control unit is mounted in an air supply duct;

said second flow controller is mounted in air return duct; and said third flow control unit is mounted in an exhaust duct.

42. A method of installing a ventilation flow control unit comprising:

preassembling said flow control unit by mounting a flow controller to a duct, mounting a flow sensor to said duct, and mounting an isolation valve to said duct to selectively block the flow of air between said duct and said flow controller; and installing said preassembled flow control unit in an HVAC system.

43. A method of installing a ventilation flow control unit according to claim 42, wherein said step of preassembling said flow control unit further includes mounting a flow straightener to said duct adjacent to said flow sensor.

44. A ventilation flow control unit comprising:

a plenum;

a flow controller mounted to said plenum;

a flow sensor mounted to said plenum;

a flow straightener mounted to said plenum adjacent said flow sensor, said flow straightener reducing the turbulence of air flowing past said flow sensor; and an electrical disconnect; and wherein said plenum, said flow controller, said flow sensor, said flow straightener, and said electrical disconnect are preassembled to form said ventilation flow control unit, thereby enabling said ventilation flow control unit to be installed in an HVAC system as a single unit.

45. A ventilation flow control system comprising:

a first flow control unit mounted in an air supply duct for controlling the flow of air into a room, said first flow control unit including a duct, a flow controller mounted to said duct, and a sensor mounted to said duct;

a second flow control unit mounted in an air return duct for controlling the flow of air out of said room, said second flow control unit including a duct, a flow controller mounted to said duct, and a sensor mounted to said duct;

a third flow control unit mounted in an exhaust duct for controlling the flow of air out of said room, said third flow control unit including a duct, a flow controller mounted to said duct, and a sensor mounted to said duct, and a control unit for receiving feedback signals from said sensors and providing control signals to said flow controllers.

46. A ventilation flow control system according to claim 45, wherein said first flow control unit further includes a thermal coil mounted to said duct of said first flow control unit.

47. A ventilation flow control system according to claim 45, wherein at least one of said flow control units includes an isolation valve.

48. A ventilation flow control system according to claim 47, wherein at least two of said flow control units include an isolation valve.

49. A ventilation flow control system according to claim 48, wherein all three of said control units include an isolation valve.

50. A ventilation flow control system according to claim 45, wherein at least one of said flow control units includes an electrical disconnect.

51. A ventilation flow control system according to claim 50, wherein said at least one of said flow control units further includes an electrical converter for converting a voltage from said electrical disconnect to a lower voltage.

* * * * *